US007762303B2

(12) United States Patent
Yu Chen

(10) Patent No.: US 7,762,303 B2
(45) Date of Patent: Jul. 27, 2010

(54) DOUBLE-SIDED TAPE DISPENSER

(76) Inventor: Hsiu-Man Yu Chen, No. 40, Sec. 1, Ta Fu Road, Tan Tzu Hsiang, Taichung County (TW)

( * ) Notice: Subject to any disclaimer, the term of this patent is extended or adjusted under 35 U.S.C. 154(b) by 154 days.

(21) Appl. No.: 12/178,742

(22) Filed: Jul. 24, 2008

(65) Prior Publication Data

US 2010/0018652 A1 Jan. 28, 2010

(51) Int. Cl.
*B29C 65/50* (2006.01)

(52) U.S. Cl. ..... 156/579; 156/344; 156/391; 156/392; 156/494; 156/495; 156/496; 156/523; 156/574; 156/577; 242/155 R; 242/334; 242/381.4; 242/410; 242/412; 242/538.1; 242/538.2; 242/588; 242/588.2; 242/588.6

(58) Field of Classification Search ..... 242/155 R, 242/334, 410, 412, 381.4, 538.1, 538.2, 583.3, 242/588, 588.2, 588.6; 156/344, 391, 392, 156/494, 495, 496, 523, 574, 577, 579
See application file for complete search history.

(56) References Cited

U.S. PATENT DOCUMENTS 6,502,616 B1 * 1/2003 Row ..... 156/463
6,651,918 B2 * 11/2003 Huang ..... 242/423.1
7,195,049 B2 * 3/2007 Downs et al. ..... 156/577
7,611,088 B1 * 11/2009 Yu Chen ..... 242/588.2
2006/0260762 A1 * 11/2006 Yu Chen ..... 156/584

* cited by examiner

*Primary Examiner*—Kat Wyrozebski
*Assistant Examiner*—Joshel Rivera
(74) *Attorney, Agent, or Firm*—Ming Chow; Sinorica, LLC

(57) ABSTRACT

A double-sided tape dispenser is provided, in which a rolling tape mechanism is axially formed at the inner wall of body. The rolling tape mechanism comprises a driving gear and a drawback gear joggling with the driving gear. A drawback roll wheel pivots onto the drawback gear. A double-sided tape pivots onto the driving gear to wind the tail of tape onto the roll wheel. Double-sided adhesive is formed over the outer circumference of double-sided tape. An adjustment part pivots onto the drawback roll wheel, so when the gear is driven to joggle with the drawback gear to run, a frictional resistance is caused between the drawback roll wheel and the drawback gear to keep the tightness of drawback of the drawback release paper, preventing the release paper from being blocked on the drawback roll wheel and then the double-sided tape from not drawing back completely.

4 Claims, 7 Drawing Sheets

DOUBLE-SIDED TAPE DISPENSER

BACKGROUND OF THE INVENTION

1. Field of the Invention

This invention relates to a double-sided tape dispenser that adjusts the degree of drawback tightness of a release paper.

2. Description of the Related Art

With reference to FIG. 1 as an assembly view of a conventional double-sided tape dispenser comprising a body 10 formed with a first shell 11 and a second shell 12, in which several protruding wedge flakes 111 are provided at a side of the circumference of first shell 11 and wedge slots 121 are formed at the outside of the circumference of second shell 12, which are opposite to the wedge flakes 111, in order to make the first shell 11 wedge to the second shell 12. A hand grasp portion 122 is formed at a lower side of the second shell 12, stretching axially outwardly. A tape release port 112 is formed where the front ends of the first shell 11 and second shell 12 are opposite to each other. A tape release seat 12 is formed outwardly and transversally at the second shell 12, which is opposite to the tape release port 112 On the tape release seat 123, a roller 124 and a carrier wheel 125 are provided sequentially and pivot axially to each other. Several ribs 125*a* are provided at intervals of distance around the circumference of carrier wheel 125. The roller 124 is arranged outside the body 10. A rolling tape mechanism 13 is provided inside the second shell 12. In the rolling tape mechanism 13, a first stationary shaft 126 and a second stationary shaft 127 that project are arranged axially close together at the inner side of second shell 12, in which a driving gear 14 pivots onto the first stationary shaft 126 and a drawback gear 15 linking with the driving gear 14 pivots onto the second stationary shaft 127. The drawback gear 15 joggles with the driving gear 14 to run in a reverse direction. A roll wheel 141 that projects is provided in the center of driving gear 14 along the first stationary shaft 126. A double-sided tape 16 is provided to scroll over the roll wheel 141 and comprises a scroll release paper 161. Double-sided adhesive is formed outside the circumference of release paper 161. The outer circumference of the tail of release paper 161 moves around the top end of carrier wheel 125 and then moves around from the inner circumference toward the lower-end side of roller 124. Finally, the tail of release paper 161 that is formed with no double-sided adhesive is made to scroll over and clip on the drawback roll wheel 151 that projects in the center of drawback gear 15.

There is no adjustment part that may properly tighten the conventional drawback release paper 161 that has scrolled on the drawback roll wheel 151. After drawback, when the amount and weight of release paper 161 on the drawback roll wheel 151 increases, the frictional resistance to the drawback gear 15 increases, making the drawback release paper 161 over the drawback roll wheel 151 and not run smoothly and not completely draw back and even skid on the surface of roller 124 to which a force is applied, thereby the follow-up functions being impacted. Thus, the first shell 11 must be separated from the second shell 12, the drawback release paper 161 must be removed, and the frictional resistance between the drawback gear 15 and the drawback roll wheel 151 must be reduced for smooth running.

Consequently, because of the technical defects of described above, the applicant keeps on carving unflaggingly through wholehearted experience and research to develop the present invention, which can effectively improve the defects described above.

SUMMARY OF THE INVENTION

It is a main object of this invention to provide a double-sided tape dispenser in which a drawback roll wheel is provided with an adjustment part for tightness adjustment. By adjusting the tightness of drawback of the release paper, the drawback release paper may be made to run smoothly, preventing the release paper from being blocked or not drawing back completely.

The double-sided tape dispenser according to this invention comprises a body. A tape release port is formed at the front ends of the body that are opposite to each other. A rolling tape mechanism is provided in the body an exit of which is formed with a tape release seat that is formed outwardly and transversally. On the tape release seat, a roller that keeps adhesive close to a determined surface, and a carrier wheel 125 are provided sequentially. A driving gear and a drawback gear that are provided to drive the tape pan pivot axially to the inner wall of body. A release paper provided with double-sided adhesive winds around the tape pan. The outer circumference of release paper moves around the carrier wheel and then the roller from the inner circumference, and the tail of release paper that is formed with no double-sided adhesive is made to scroll over and clip on the drawback roll wheel. This invention is mainly characterized that an adjustment part is provided on a central axis of the drawback gear, mainly comprising a shift limit bush. A projecting shift limit portion is provided in the shift limit bush at two relatively axial sides. A compression spring is axially set around the shift limit bush. Relatively, an adjustment ring is set around a top end of the compression spring to make the compression spring compress the drawback roll wheel and the drawback gear for a radial frictional resistance, and thus the release paper is made to drive and draw back toward the drawback roll wheel through the roller; at the same time, the drawback roll wheel and the drawback gear run reversely. A concave portion is axially formed at the inner wall of adjustment ring that is opposite to the shift limit portion. Several adjustment portions the sets of depth of which are different are axially formed around among the concave portions. The top ends of adjustment portions communicate with each other. With the adjustment ring axially running, the compression spring is compressed toward a determined adjustment portion to cause a frictional resistance between the drawback roll wheel and the drawback gear, making the drawback roll wheel and the drawback gear smoothly run reversely. When the amount and weight of drawback release papers on the drawback scroll increases, the degree of tightness of the adjustment ring that pushes down the compression spring may increase to wedge the adjustment portion, keeping proper frictional resistance between the drawback roll wheel and the drawback gear to easily adjust the release paper for the degree of tightness at the time of drawback.

DETAILED DESCRIPTION OF THE PREFERRED EMBODIMENTS

Now, the present invention will be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
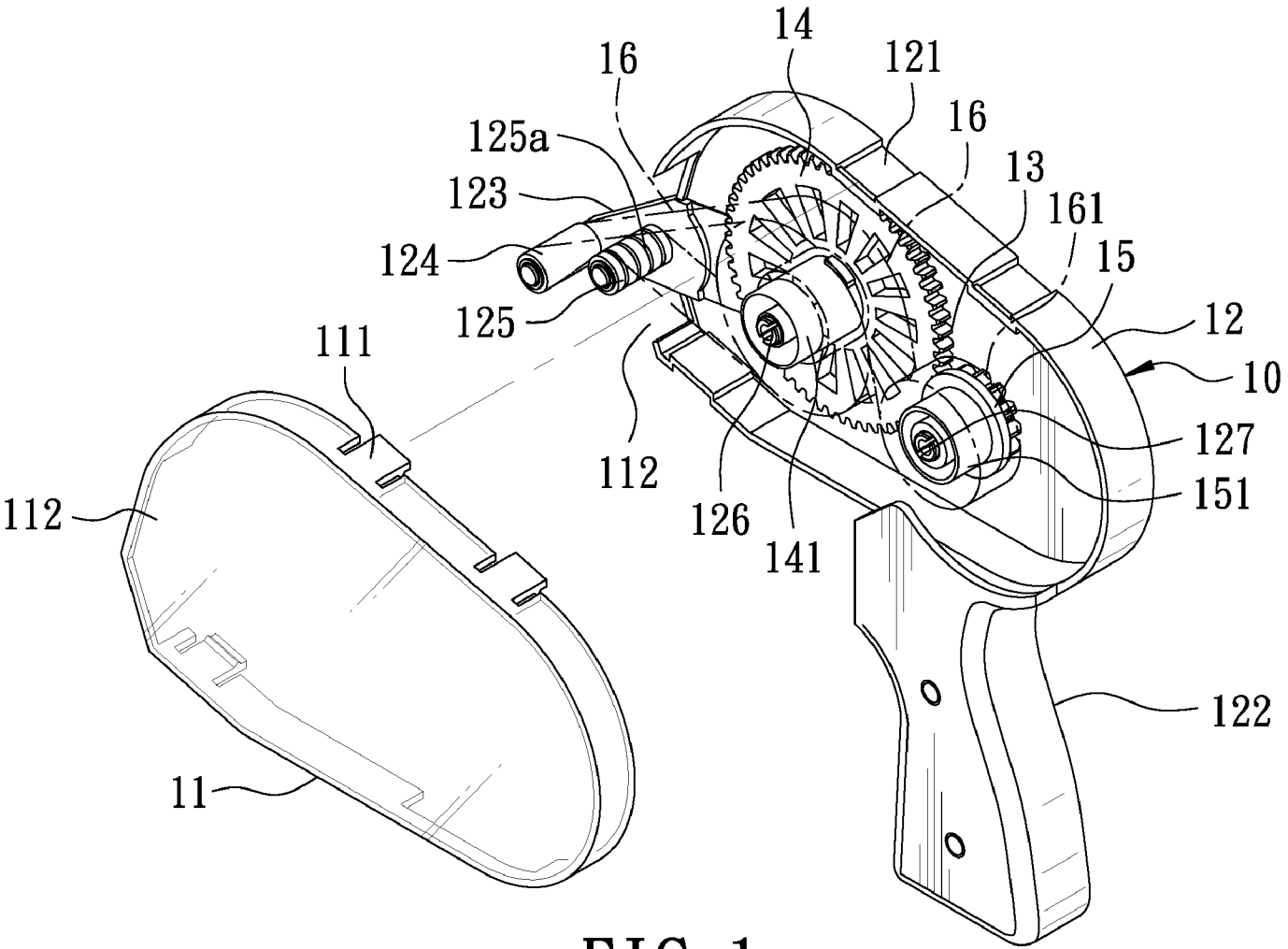
FIG. 1 PRIOR ART
FIG. 1 is an assembly view of a conventional double-sided tape dispenser.
Figure 2:
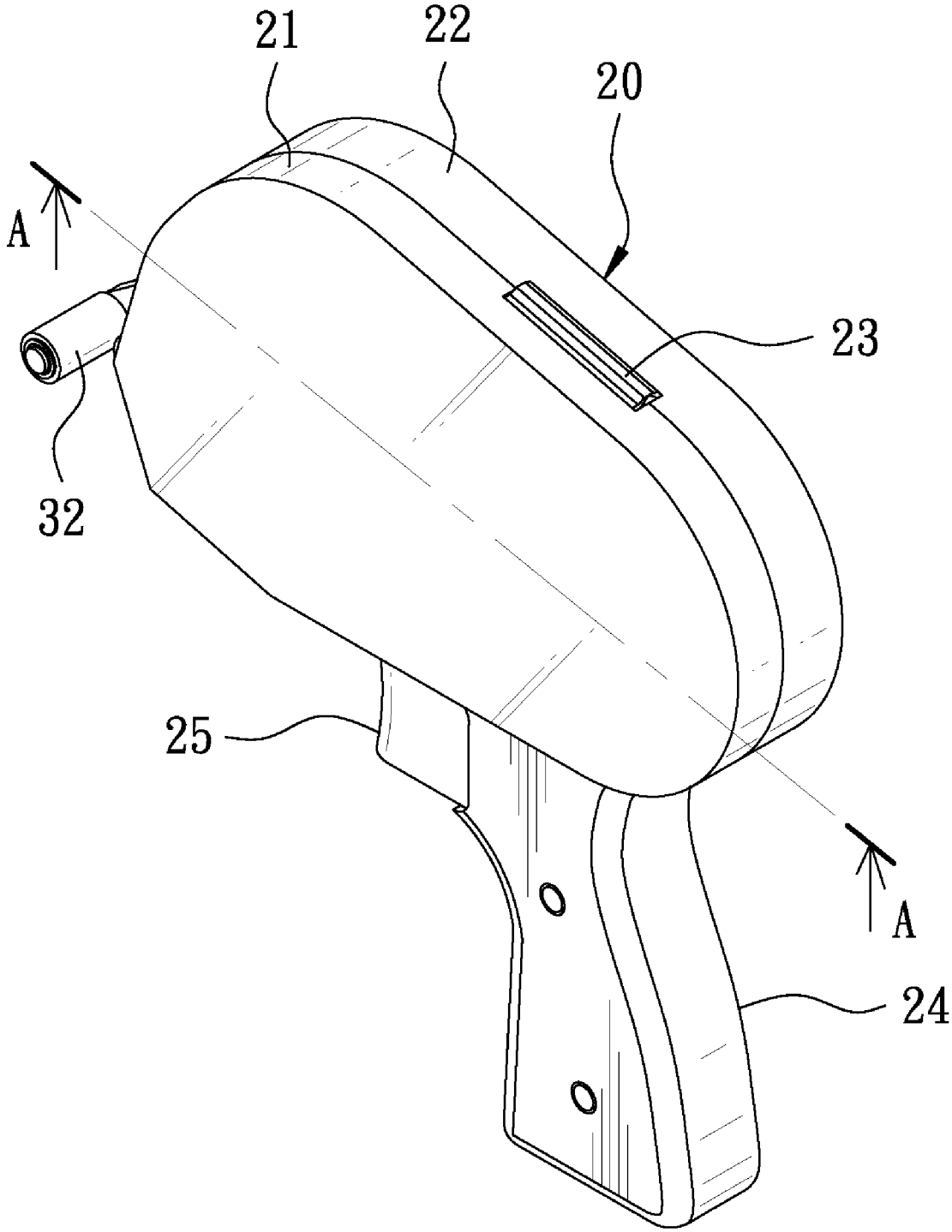
FIG. 2 is a perspective view of this invention.
Figure 3:
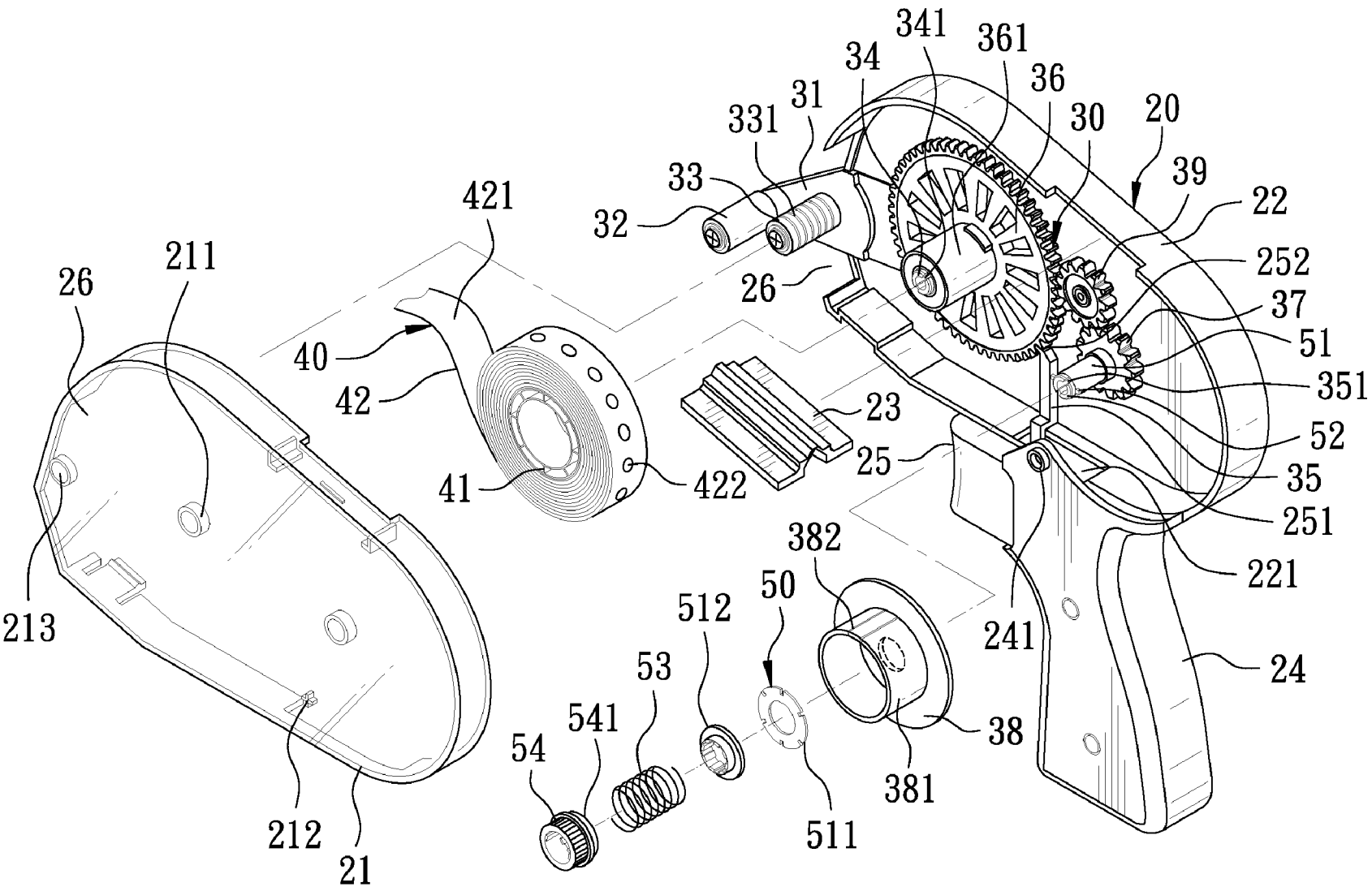
FIG. 3 is a partial exploded view of this invention.

With reference to FIGS. 2 and 3 as a perspective view and an exploded view, a double-sided tape dispenser according to this invention comprises a body 20, a rolling tape mechanism 30, a tape pan 40, and an adjustment part 50.

The body 20 is assembled with a first shell 21 and a second shell 22. The upside of first shell 21 aligns with that of second shell 22 and the two shells are combined with each other through a pivot portion 23. The pivot portion 23 is a rectangular lump the central axis of which is formed with a rib that make the two sides of pivot portion 23 movably pivot onto the first shell 21 and the second shell 22. Two projecting hollow cylindrical first wedges 211 are provided in the center of inner side of the first shell 21. A tetragonal wedge rib 212 is formed at another side of the pivot portion 23. A hand grasp portion 24 is formed in the second shell 22 opposite to another side of pivot portion 23, stretching axially outwardly. In the hand grasp portion, a projecting hollow cylindrical second wedge 241 is formed to align with and wedge onto the wedge rib 212. A tape release port 26 is formed where the front ends of the first shell 21 and second shell 22 are opposite to each other. Further, at the inner side of first shell 21, a hollow cylindrical third wedge 213 is provided that aligns with a tape release port 26.

Figure 4:
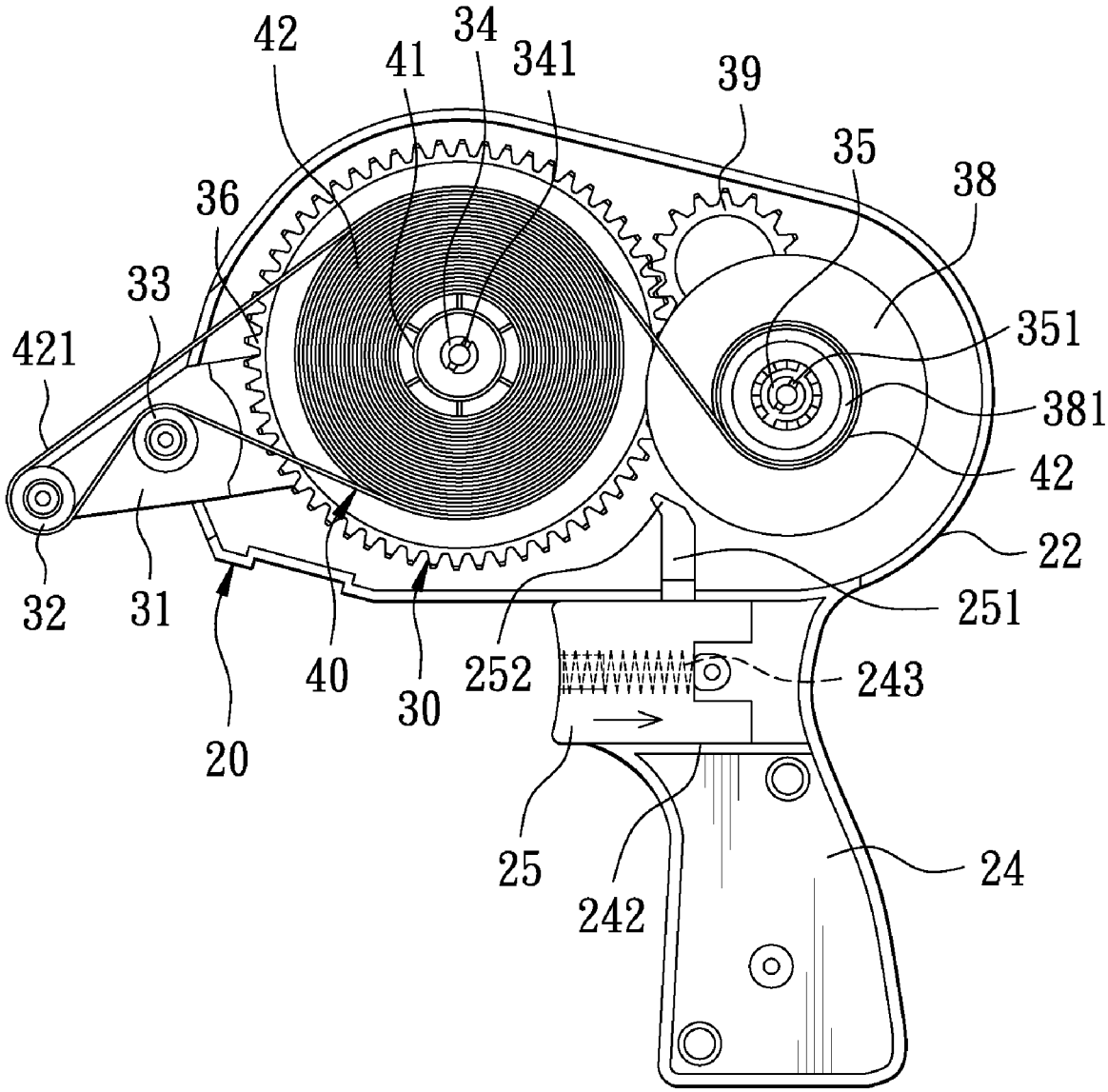
FIG. 4 is a partial sectional top view of this invention, illustrating a hand grasp portion is held to press a control block and then make a control rod leave from a rolling tape mechanism.

Refer to FIG. 4 as a partial sectional top view of this invention, illustrating a hand grasp portion that is held to press a control block and then make a control rod leave from a rolling tape mechanism. A concave glide groove 242 is radially formed at a front side of the hand grasp portion 24. A control block 25 is arranged at a mouth of the glide groove 242. In the control block 25, a compression spring 243 is provided that is opposite to the inner side of glide groove 242. In the block 25 facing toward the second shell 22, a projecting and stretching control rod 251 is provided that is opposite to a concave nick 221. A free end of the control rod 251 is bent and kept close to a side of the nick 221 in the second shell 22 and stretch toward the outer ring of a side of the rolling tape mechanism 30. At the end of control rod 251, a wedge tooth 252 is provided to push down the control block 25 to back and forth glide in the hand grasp portion 24, and to link with the control rod 251 to glide on the second shell 22, making the wedge tooth 252 wedge to or leave from the outer circumference of one side of the rolling tape mechanism 30.

Further with reference to FIGS. 3 and 4, the rolling tape mechanism 30 is provided in the second shell 22. A tape release seat 22 that is in the shape of rectangular plate is formed outwardly and transversally at the second shell 12, which is opposite to the tape release port 26. Onto the tape release seat 31, a roller 32 and a carrier wheel 33 the outer circumference of which is formed with several annular ribs 331 kept from each other at intervals of distance axially pivot sequentially from the front. Further, the roller 32 is exposed to the body 20. The third wedge 213 of the first shell 21 is opposite to the carrier wheel 33 to align with and wedge to the central axis of carrier wheel 33. At the inner wall of the center of second shell 22, a first stationary shaft 34 and a second stationary shaft 35 that project are arranged axially close together. Concave cut grooves 341 and 351 are formed along a radial center line respectively at the first stationary shaft 34 and the second stationary shaft 35 for the first wedge 211 of the first shell 21 to wedge to the first stationary shaft 34 and the second stationary shaft 35, in which the cut grooves 341 and 351 wedge flexibly. A driving gear 36 pivots onto the first stationary shaft 34, in which one side at the outer edge of tooth is wedged by the wedge tooth 252 of the control rod 251. Further, a projecting hollow bush 361 is provided at the driving gear 36 at a determined distance along the outer circumference of first stationary shaft 34. A drawback gear 37 pivots to the second stationary shaft 35, and a drawback roll wheel 38 is set around the second stationary shaft 35 opposite to the top end of drawback gear 37. The drawback roll wheel 38 is in the form of approximately hollow pan, on which a projecting hollow scroll 381 is provided at a determined distance, being opposite to the outer circumference of second stationary shaft 35. One side of the scroll 381 is cut into two grooves 382. Next, a joggle gear 39 pivots between the driving gear 36 and the drawback gear 37 to joggle the driving gear 36 and the drawback gear 37.

The tape pan 40, pivoting onto the first stationary shaft 34, mainly comprises a roll wheel 41. A double-sided tape 42 is provided to scroll over the roll wheel 41 and comprises a release paper 421. Several dots of double-sided adhesive 422 that are arranged at equidistant intervals of distance are formed outside the circumference of release paper 421. The outer circumference of the release paper 421 moves around the top end of carrier wheel 33 and then stretches downwards and moves around the lower side of roller 32 from the inner circumference toward the lower-end side of roller, the tail of release paper 421 that is formed with no double-sided adhesive is made to stretch downwards, scroll over, and clip the groove 382 on the scroll 382.

The adjustment part 50, being provided on the drawback roll wheel 38 pivoting onto the second stationary shaft 35 and being arranged in the center of scroll 381, mainly comprises a shift limit bush 51 that stretches from the drawback gear 37 along the outer circumference of second stationary shaft 35 and that is fully set around the second stationary shaft 35. A transversally projecting shift limit portion 52 is provided in the shift limit bush 51 at two relatively axial sides. The shift limit portion 52 is formed into a rectangular lump. Around the shift limit bush 51, a cushion 511 and a projecting shift limit ring 512 are axially set sequentially. The front end of shift limit ring 512 has a smaller diameter of outer ring and is arranged at the bottom of a compression spring 53 to limit the shift of compression spring 53 that stays axially close. An adjustment ring 54 is set around the front end of compression spring 53. Around the adjustment ring 54, a blocking surface 541 opposite to the compression spring 53 is formed to make the compression spring 53 compress the drawback roll wheel 38 and the drawback gear 37 for a radial frictional resistance, and thus the release paper 421 is made to drive and draw back toward the drawback roll wheel 38 through the roller 32, thereby making the drawback roll wheel 38 and the drawback gear 37 run reversely.

Figure 5:
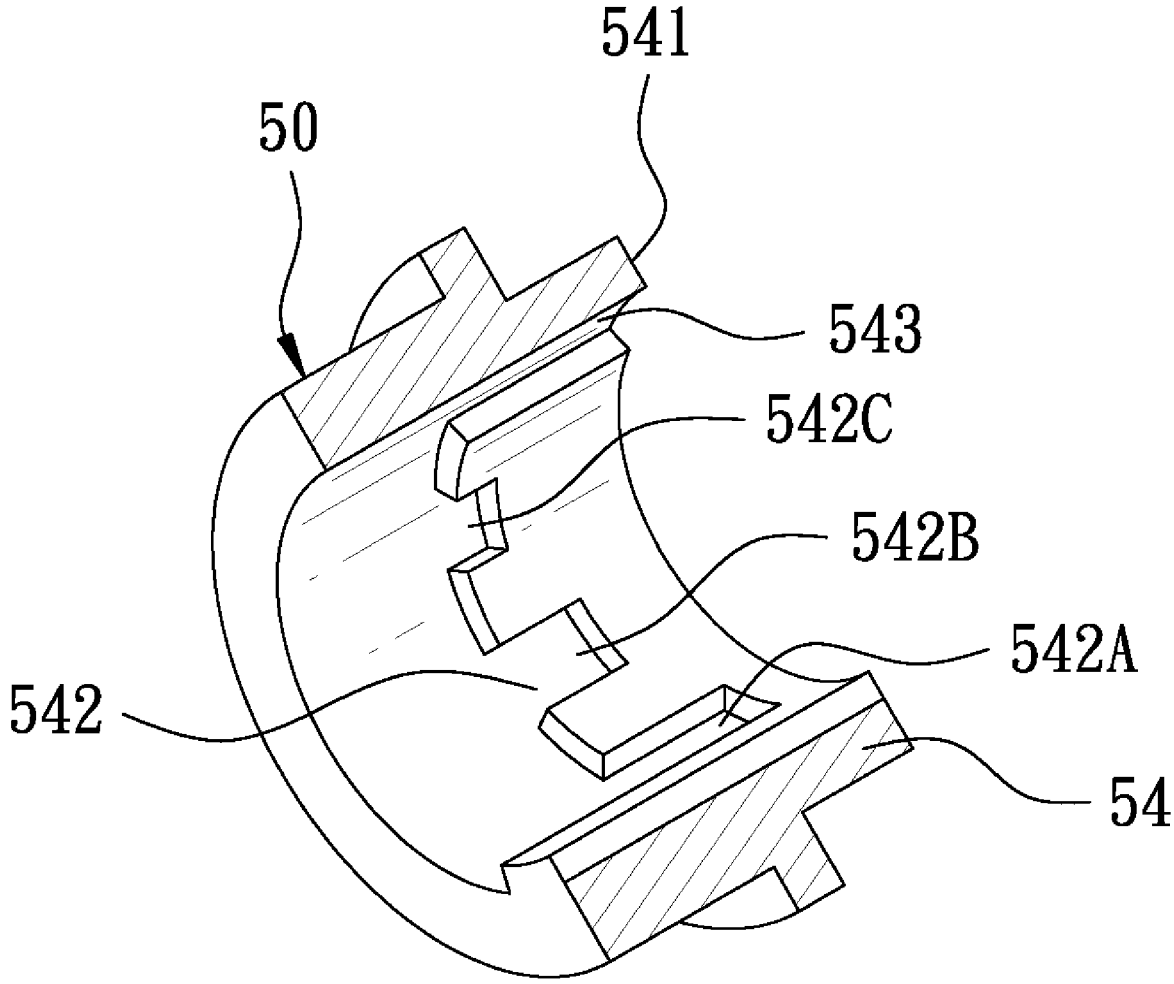
FIG. 5 is a partial enlarged view of an adjustment ring according to this invention, illustrating that 3 adjustment portions the sets of depth of which are different are formed thereon.

Refer to FIG. 5 as a partial enlarged view of an adjustment ring according to this invention, illustrating that 3 adjustment portions the sets of depth of which are different are formed thereon. At the inner surrounding wall of adjustment ring 54, a concave portion is axially formed, which is opposite to the shift limit portion 52, to wedge onto the top end of shift limit bush 51. Three adjustment portions 542 the sets of depth of which are different are formed in parallel symmetrically and axially among the concave portions 542 of the adjustment ring 54. The adjustment portions 54 are rectangular caves the sets of depth are different, respectively a first section 542A, a second section 542B, and a third section 542C, in order to adjust the scroll 381 for tightness in 3 sections. The top ends of adjustment portions 542 communicate with each other to radially turn the adjustment ring 54 and then press the compression spring 53 toward a determined adjustment portions 542 for clamping and maintenance of the tightness of release paper 421 when drawing back.

In order to further make apparent the structural features, applied skill and manners, and expected effects according to this invention, what are applied in this invention are in detail described, and it is thus believed that this invention is thoroughly and concretely apparent, as described below.

Figure 6:
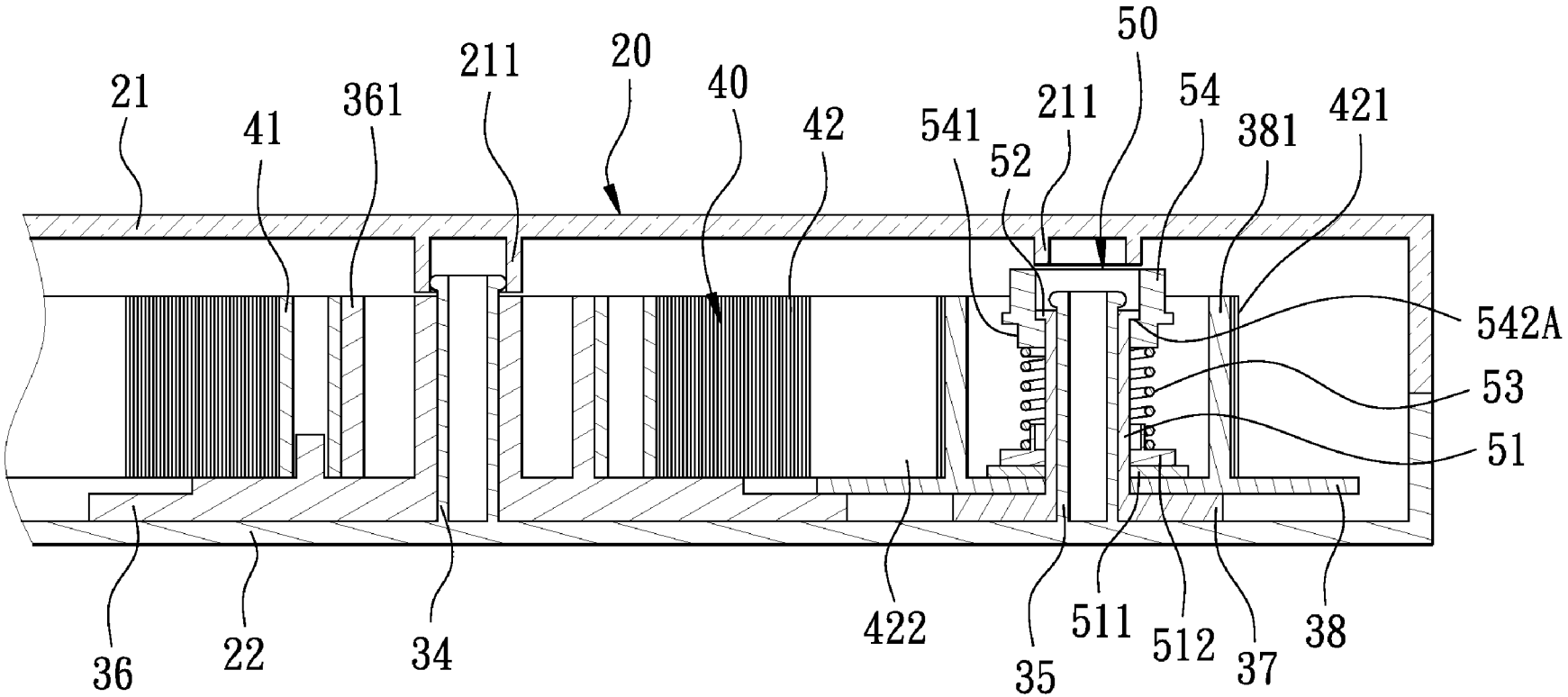
FIG. 6 is a view of section A-A of FIG. 2 of this invention, illustrating an adjustment part that is tightened at section 1.

Refer to FIG. 6 is a view of section A-A of FIG. 2 of this invention, illustrating the adjustment part that is tightened at section 1. When the double-sided tape dispenser is used, if the release paper 421 on the drawback scroll 38 is not thick, the adjustment ring 54 of the adjustment part 50 may be regulated along a radial to turn to downwards axially press the compression spring 53 and may be located at a random section of the adjustment portions 542 so that the compression spring 53 may compress the drawback roll wheel 38 and the drawback gear 37 for a radial frictional resistance and thus the release paper 421 may drive and draw back toward the drawback roll wheel 38 through the roller 32 for keeping the tightness of drawback of the drawback roll wheel 38; generally, when it is adjusted to the first section 542A, the maximum depth of adjustment portion 542, the adjustment ring 54 may lies at a highest section of the three sections to press the compression spring 53 for a determined tightness.

Figure 7:
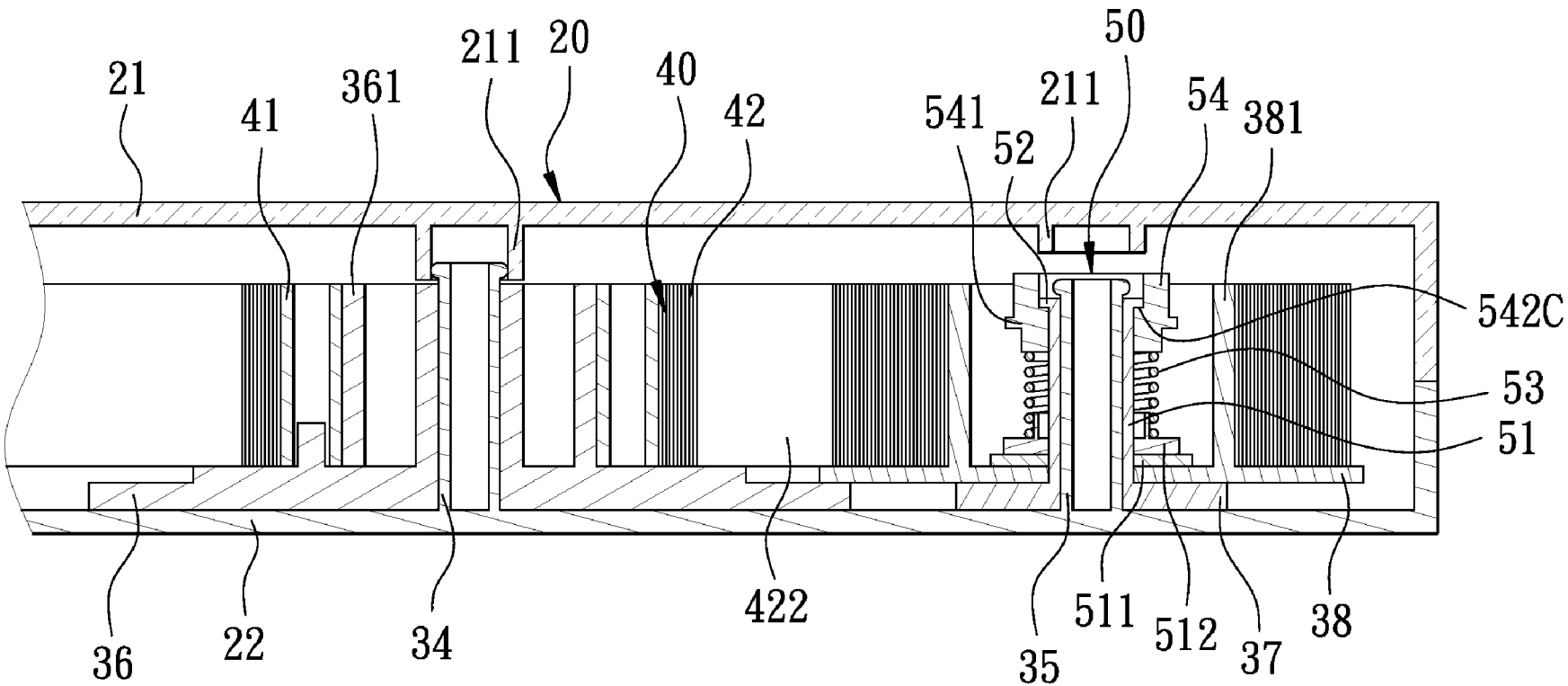
FIG. 7 is a view of section A-A of FIG. 2 of this invention, illustrating the adjustment part that is tightened at section 3.

Refer to FIG. 7 as a view of section A-A of FIG. 2 of this invention, illustrating the adjustment part that is tightened at section 3. After the double-sided tape dispenser is used for a period of time, if the release paper 421 on the drawback scroll 38 is thick and heavy, namely a frictional resistance between the drawback roll wheel 38 and the drawback gear 37 becoming higher so that the compression spring 53 must be adjusted to tighten the drawback roll wheel 38 and the drawback gear 37, the adjustment ring 54 of the adjustment part 50 may be regulated along a radial to turn to downwards axially press the compression spring 53 and the compression spring 53 may be lower than the first section 542A and located at the third section or second section 542B of the adjustment portion 542 for increase of the tightness and enhancement of the frictional resistance between the drawback roll wheel 38 and the drawback gear 37, thereby making the release paper 421 smoothly scroll and draw back toward the drawback roll wheel 38 through the roller 32 for maintenance of the tightness of drawback of the drawback roll wheel 38 and for subsequent smooth operation.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A double-sided tape dispenser, comprising:

a body one side of which is formed with a tape release port and another side near the tape release port is formed with a hand grasp portion that stretches outwards;

a rolling tape mechanism axially formed in the body, in which a tape release seat that is formed outwardly and transversally opposite to the tape release port, a roller that keeps adhesive close to a determined surface, and a carrier wheel are provided sequentially on the tape release seat, a first stationary shaft and a second stationary shaft that project are arranged axially close together at the inner wall of body, a driving gear pivots onto the first stationary shaft, a double-sided tape pivots onto the driving gear, a drawback gear linking with the driving gear pivots onto the second stationary shaft, and a drawback roll wheel pivots onto the drawback gear;

an adjustment part being provided on the drawback roll wheel pivoting onto the second stationary shaft and mainly comprising a shift limit bush one side of which is formed with a shift limit portion, in which a compression spring is axially set around the shift limit bush, an adjustment ring is set around the front end of compression spring, and at the inner surrounding wall of adjustment ring, several adjustment portions the sets of concave depth of which are different are provided that are opposite to the shift limit portion; and at the inner surrounding wall of the adjustment ring, a concave portion is axially formed, which is opposite to the shift limit portion, to wedge the adjustment ring onto the top end of shift limit bush, and three adjustment portions the sets of depth of which are different are formed in parallel symmetrically and axially among the concave portions of the adjustment ring, the portions being respectively a first section, a second section, and a third section, in order to adjust drawback roll wheel for tightness in three (3) sections.

2. The double-sided tape dispenser according to claim 1, wherein the drawback roll wheel is in the form of approximately hollow pan, on which a projecting hollow scroll is provided at a determined distance, being opposite to the outer circumference of second stationary shaft.

3. The double-sided tape dispenser according to claim 1, wherein the shift limit portion is formed into a rectangular lump.

4. The double-sided tape dispenser according to claim 1, wherein the adjustment portions are rectangular caves the sets of depth of which are different.

* * * * *